US010781508B2

(12) United States Patent
Liu et al.

(10) Patent No.: US 10,781,508 B2
(45) Date of Patent: Sep. 22, 2020

(54) HIGH-STRENGTH AND HIGH-CONDUCTIVITY COPPER ALLOY AND APPLICATIONS OF ALLOY AS MATERIAL OF CONTACT LINE OF HIGH-SPEED RAILWAY ALLOWING SPEED HIGHER THAN 400 KILOMETERS PER HOUR

(71) Applicant: Zhejiang University, Hangzhou (CN)

(72) Inventors: Jiabin Liu, Hangzhou (CN); Yuqing Xu, Hangzhou (CN); Hongtao Wang, Hangzhou (CN); Youtong Fang, Hangzhou (CN); Liang Meng, Hangzhou (CN); Litian Wang, Hangzhou (CN); Yu Tian, Hangzhou (CN)

(73) Assignee: Zhejiang University, Hangzhou (CN)

( * ) Notice: Subject to any disclaimer, the term of this patent is extended or adjusted under 35 U.S.C. 154(b) by 222 days.

(21) Appl. No.: 15/777,328

(22) PCT Filed: May 15, 2017

(86) PCT No.: PCT/CN2017/084336

§ 371 (c)(1),
(2) Date: May 18, 2018

(87) PCT Pub. No.: WO2017/198127

PCT Pub. Date: Nov. 23, 2017

(65) Prior Publication Data

US 2018/0355458 A1 Dec. 13, 2018

(30) Foreign Application Priority Data

May 16, 2016 (CN) ..... 2016 1 0321078

(51) Int. Cl.

| | |
|---|---|
| ***C22C 9/00*** | (2006.01) |
| ***C22C 1/03*** | (2006.01) |
| ***C22F 1/08*** | (2006.01) |
| ***H01B 1/02*** | (2006.01) |
| ***C22C 1/02*** | (2006.01) |

(52) U.S. Cl.

CPC ..... *C22C 9/00* (2013.01); *C22C 1/02* (2013.01); *C22C 1/03* (2013.01); *C22F 1/08* (2013.01); *H01B 1/026* (2013.01)

(58) Field of Classification Search

CPC ..... C22C 1/02; C22C 1/03; C22C 9/00; C22F 1/08; H01B 1/026

See application file for complete search history.

(56) References Cited

FOREIGN PATENT DOCUMENTS

| | | | |
|---|---|---|---|
| CN | 1818109 | A | 8/2006 |
| CN | 1856588 | A | 11/2006 |
| CN | 101531149 | A | 9/2009 |
| CN | 101821416 | A | 9/2010 |
| CN | 104745989 | A | 7/2015 |
| CN | 106011517 | A | 10/2016 |
| JP | 1992254558 | A | 9/1992 |
| JP | 1998140267 | A | 5/1998 |

OTHER PUBLICATIONS

International Search Report issued in PCT-CN2017-084336 dated Aug. 23, 2017.

Written Opinion issued in PCT-CN2017-084336 dated Aug. 23, 2017.

*Primary Examiner* — Jenny R Wu

(57) ABSTRACT

A high-strength and high-conductivity copper alloy and applications of the alloy as a material of a contact line of a high-speed railway allowing a speed higher than 400 kilometers per hour. The copper alloy has the following characteristics: (1) constituents of the copper alloy are in the form of CuXY, X is one or more selected from Ag, Nb and Ta, and Y is one of more selected from Cr, Zr and Si; (2) at a room temperature, the element X in the copper alloy exists in the form of a pure phase and solid solution atoms, the element Y exists in the form of a pure phase and solid solution atoms or a CuY compound and solid solution atoms, the content of the element X existing in the form of the solid solution atoms is lower than 0.5%, and the content of the element Y existing in the form of the solid solution atoms is lower than 0.1%; and (3) the copper alloy exists in the form of long strip rods or lines, the element X in the form of the pure phase is embedded in the copper alloy in the form of fibers disposed in parallel approximately, and the axial direction of the fibers is approximately in parallel with the axial direction of the copper alloy rods or lines; and the element Y existing in the copper alloy in the form of the pure phase or the CuY compound is embedded in the copper alloy in the form of particles. The copper alloy is suitable for being used as a material of a contact line of a high-speed railway allowing a speed higher than 400 kilometers per hour.

9 Claims, 2 Drawing Sheets

HIGH-STRENGTH AND HIGH-CONDUCTIVITY COPPER ALLOY AND APPLICATIONS OF ALLOY AS MATERIAL OF CONTACT LINE OF HIGH-SPEED RAILWAY ALLOWING SPEED HIGHER THAN 400 KILOMETERS PER HOUR

RELATED APPLICATIONS

This application is a 35 U.S.C. § 371 national phase application of PCT/CN2017/084336 (WO2017/198127), filed on May 15, 2017 entitled "High-Strength and High-Conductivity Copper Alloy and Applications of Alloy as Material of Contact Line of High-Speed Railway Allowing Speed Higher Than 400 Kilometers Per Hour", which application claims the benefit of Chinese Application Serial No. 201610321078.2, filed May 16, 2016, which is incorporated herein by reference in its entirety.

FIELD OF THE INVENTION

The present invention relates to a Cu alloy and its applications as contact wire materials of high speed railways, in particular, high speed railways at a speed of over 400 km per hour.

BACKGROUND

Since 2009, China's high-speed electrified railways (hereinafter referred to as HSR) have got substantial and leap-forward development. Beijing-Tianjin, Beijing-Shanghai and Beijing-Guangzhou railway lines were opened successively, and the stable running speed of HSR is 300 km/h. There are great market demands and strict performance requirements for the contact wire, a critical component of HSR, due to its development. It is required that materials used as the contact wire shall have all of the following features: high strength, low linear density, good electrical conductivity, good abrasion resistance and corrosion resistance, etc., in particular, strength and conductivity are the most core indexes.

At present, conductor materials adopted for the contact wire are mainly Cu—Mg, Cu—Sn, Cu—Ag, Cu—Sn—Ag, Cu—Ag—Zr, Cu—Cr—Zr and other Cu alloys, among which Cu—Cr—Zr shows a more excellent combination property of strength and conductivity. Patents CN200410060463.3 and CN200510124589.7 disclose the preparation technology of Cu-(0.02~0.4)% Zr-(0.04~0.16)% Ag and Cu-(0.2~0.72)% Cr-(0.07~0.15)% Ag, which is to prepare finished products through smelting, casting, thermal deformation, solid solution, cold deformation, aging and cold deformation again. Patent CN03135758.X discloses a preparation method of using rapid solidification powder processing, compaction, sintering and extrusion to obtain Cu-(0.01~2.5)% Cr-(0.01~2.0)% Zr-(0.01~2.0)% (Y, La, Sm) alloy rods or sheets, which can obtain good electrical conductivity, thermal conductivity and softening resistance properties. Patent CN200610017523.2 discloses Cu-(0.05~0.40)% Cr-(0.05~0.2)% Zr-<0.20% (Ce+Y) alloy composition and its preparation technology, which is to obtain high-strength and high-conductivity combination property and good heat resistance and abrasion resistance properties through smelting, casting, solid solution, deformation and aging. Patent CN02148648.4 discloses Cu-(0.01~1.0)% Cr-(0.01~0.6)% Zr-(0.05~1.0)% Zn-(0.01~0.30)% (La+Ce) alloy composition and its preparation technology, which is to obtain relatively high strength and conductivity through smelting, hot rolling, solid solution, cold rolling, aging and finished rolling.

U.S. Pat. No. 6,679,955 discloses the preparation technology of Cu-(3~20)% Ag-(0.5~1.5)% Cr-(0.05~0.5)% Zr alloy by obtaining supersaturated solid solution through rapid solidification and precipitation hardening through thermo-mechanical treatment. U.S. Pat. No. 7,172,665 discloses the preparation technology of Cu-(2~6)% Ag-(0.5~0.9)% Cr alloy, and the processes comprise uniform post-processing, thermal deformation and solution treatment, and (0.05~0.2)% Zr can be added. U.S. Pat. No. 6,881,281 provides a high-strength and high-conductivity Cu-(0.05~1.0)% Cr-(0.05~0.25)% Zr alloy excellent in fatigue and intermediate temperature characteristics, which is to adjust the concentration of S by strictly controlling the parameters of solution treatment so as to ensure good properties.

With the continuous development of high-speed electrified railways, in particular, China's "$13^{th}$ Five-year Plan" clearly proposes that the high-speed railway system at a speed of over 400 km/h shall be completed by 2020, so that the properties of the matching contact wire materials must be improved to such a level: strength >680 MPa, conductivity >78% IACS and the reduction rate of strength after annealing for 2 h at 400° C.<10%. Due to such strict performance standards, Cu—Mg, Cu—Sn, Cu—Ag, Cu—Sn—Ag, Cu—Ag—Zr and Cu—Cr—Zr alloys used currently fail to meet the minimum requirements for the contact wire materials of the high-speed railway system at a speed of over 400 km/h. Therefore, new high-performance alloys must be developed to adapt to the continuous and accelerated development of high-speed railways.

SUMMARY

The object of the present invention is to provide a high-strength and high-conductivity copper alloy and its application as the contact wire materials of high speed railways, and such copper alloy can meet the requirements of the high-speed railway system at a speed of over 400 km/h for the contact wire materials.

Below is the detailed description of the technical solutions adopted in the present invention to realize the above object.

The present invention provides a copper alloy, having the following features:

1. The copper alloy composition conforms to the form: CuXY, of which X is selected from at least one of Ag, Nb and Ta, Y is from at least one of Cr, Zr and Si; in the copper alloy, the total content of X element shall be greater than 0.01% and no higher than 20%, the total content of Y element shall be greater than 0.01% and no higher than 2%, moreover, the Cr content ranges from 0.01% to 1.5%, Zr content ranges from 0.01% to 0.5%, and Si content ranges from 0.01% to 0.3%;

2. At room temperature, X element in the copper alloy exists in the forms of pure phase and solid solution atom, of which the X content in the latter form is less than 0.5%; Y element exists in the forms of pure phase and solid solution atom or CuY compound and solid solution atom, of which the Y content in the form of solid solution atom is less than 0.1%;

3. The copper alloy exists in the form of long bar or wire, of which X element in the form of pure phase is embedded in the copper alloy in the form of approximately parallel arranged fibers. The axial direction of the fiber is roughly parallel to that of the copper alloy bar or wire, and the diameter of the fiber is less than 100 nm, its length is greater than 1000 nm and the distance between fibers is less than 1000 nm. The phase interface between fiber and Cu matrix is a semi-coherent interface, on which periodically arranged misfit dislocation is distributed; it can be understood by those skilled in the art that the arrangement of X fiber in the copper alloy can not be the mathematically absolute "parallel arrangement", and the description that the axial direction of the fiber is parallel to that of the copper alloy bar or wire does not mean the mathematically absolute "axial parallel", so "approximately" and "roughly" words are used here, which is more in line with the actual situation;

Y element in the form of pure phase or compound is embedded in the copper alloy in the form of particles, and over 30% particles are distributed on the phase interface between X fiber and Cu matrix. The diameter of particles is less than 30 nm, the distance between particles is less than 200 nm, and the phase interface between particle and Cu matrix and between particle and X fiber is semi-coherent interface or incoherent interface.

The percentage composition of element content and copper alloy composition involved in the present invention is mass content and mass percent.

Further, the total content of X element in the copper alloy is preferably 3%~12%.

Further, the total content of Y element in the copper alloy is preferably 0.1%~1.5%. Still further, the copper alloy is one of the following: Cu-12% Ag-0.3% Cr-0.1% Zr-0.05% Si, Cu-12% Ag-12% Nb-1.3% Cr-0.4% Zr-0.3% Si, Cu-0.1% Ag-0.1% Cr-0.1% Zr, Cu-12% Nb-1% Cr-0.4% Zr-0.1% Si, Cu-6% Ag-6% Ta-0.1% Cr and Cu-3% Ag-0.8% Cr-0.5% Zr-0.3% Si.

Further, the copper alloy is prepared through the following method: put the simple substance and/or intermediate alloy raw materials into the vacuum melting furnace according to the designed alloy composition proportion, increase the temperature, melt and cast in the mould to obtain ingot casting, transform the ingot casting into long bar or wire after multi-pass drawing at room temperature, to make the cross section shrinking ratio of the sample reach over 80%, then anneal the long bar or wire at a temperature without spheroidizing fracture of fibers of X elementary composition and with making Y element form nano-sized precipitated phase, and the annealing time shall be selected without spheroidizing fracture of fibers of X elementary composition and with making Y element greater than 50% form nano-sized precipitated phase, and draw the obtained alloy again, during which the cross section shrinking ratio of the sample is less than 50%, then freeze the obtained alloy with liquid nitrogen, so that the residual X or Y solid solution atom in the copper matrix continue to separate out, then slowly increase the temperature to room temperature so as to obtain copper alloy.

Still further, the duration for liquid nitrogen freezing treatment is preferably 1~100 hour(s).

Still further, after the liquid nitrogen freezing treatment of the alloy, it is preferable to increase the temperature to room temperature at a rate of 2~10° C./min.

In the present invention, the raw materials for preparation could be a single substance and/or intermediate alloy, and the intermediate alloy could be Cu-(5%~50%)Nb, Cu-(3%~20%)Cr, Cu-(4%~15%)Zr and Cu-(5%~20%)Si, etc.

The strength of the copper alloy disclosed in the present invention reaches over 690 MPa, its conductivity reaches over 79% IACS and the strength reduction rate <10% after annealing at 400° C. for 2 h, thus reaching the requirements for the contact wire materials of high-speed railway system at a speed of over 400 km/h. Therefore, the present invention further provides the application of the copper alloy as the contact wire materials of high speed railways, in particular, at a speed of over 400 km per hour.

Compared with prior art, the copper alloy disclosed in the present invention can achieve the following advantageous effects:

1. The present invention uses the high density nano-fiber formed by X element to effectively hinder the dislocation movement so as to produce a great nano-fiber strengthening effect and improve the overall strength level of the alloy, so that the strength of the copper alloy can reach over 690 MPa;

2. It can reduce the scattering of electron waves on the phase interface by using the parallel relationship between the axial direction of fiber and that of the alloy bar or wire, to ensure the alloy conductivity remains at a higher level and reaches over 79% IACS;

3. By pinning nanoparticles on the phase interface between fiber and copper matrix, it can prevent the spheroidizing trend of nano-fiber during annealing, and ensure the alloy has a very high anti-softening temperature and the strength reduction rate <10% after annealing at 400° C. for 2 h.

4. It can reduce the solid solubility of the alloy element in the copper matrix significantly by using the liquid nitrogen low-temperature treatment, and improve the precipitation trend, promote the residual solid solution atom to continue to separate out, so as to further purify the copper matrix and improve the conductivity.

DETAILED DESCRIPTION

Figure 1:
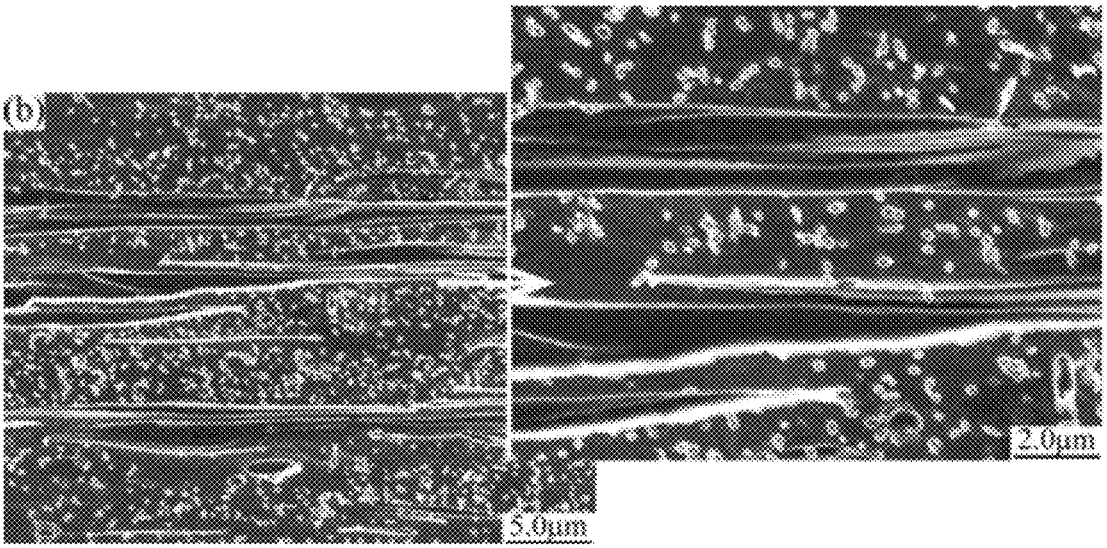
FIG. 1 is a scanning electron microscope (SEM) graph of the copper alloy obtained in Example 4.
Figure 2:
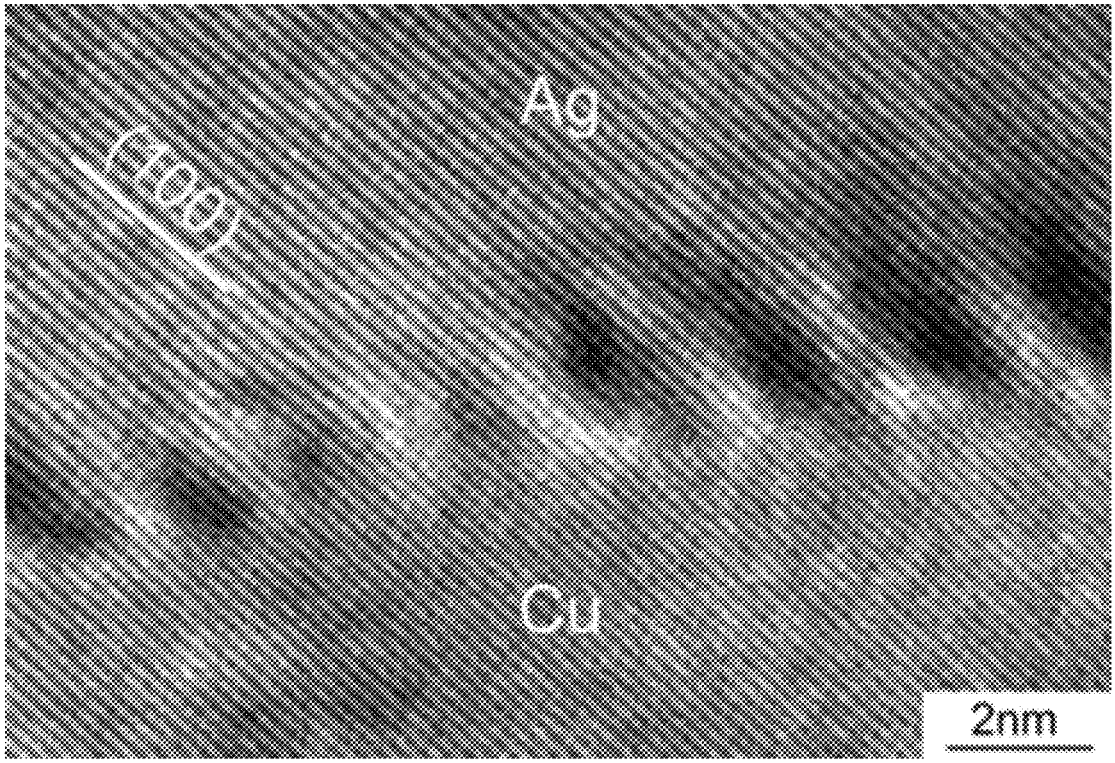
FIG. 2 is a transmission electron microscope (TEM) graph of the semi-coherent interface between Ag fiber and Cu matrix in the alloy obtained in Example 1, on which periodically arranged misfit dislocation exists.
Figure 3:
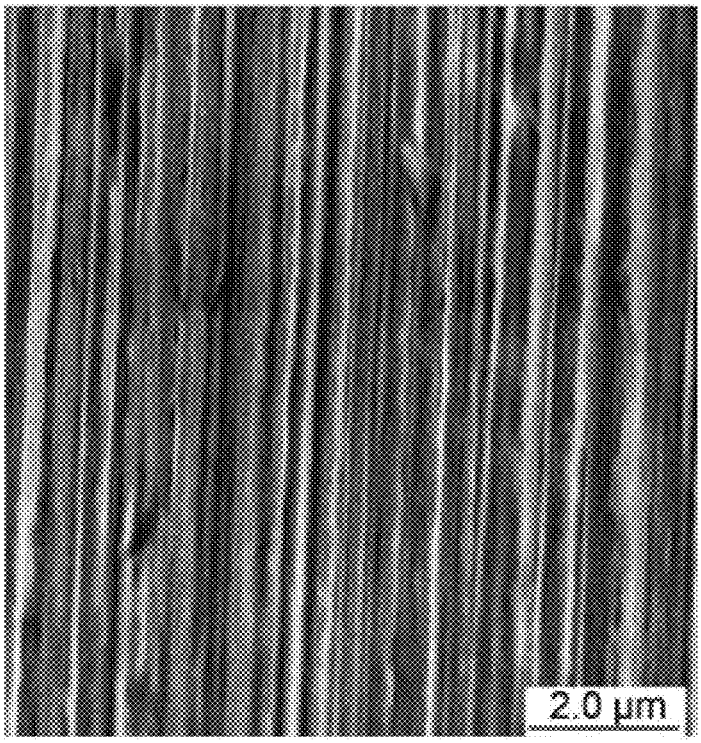
FIG. 3 is a scanning electron microscope (SEM) graph of the Nb nano-fiber in the alloy obtained in Example 2.
Figure 4:
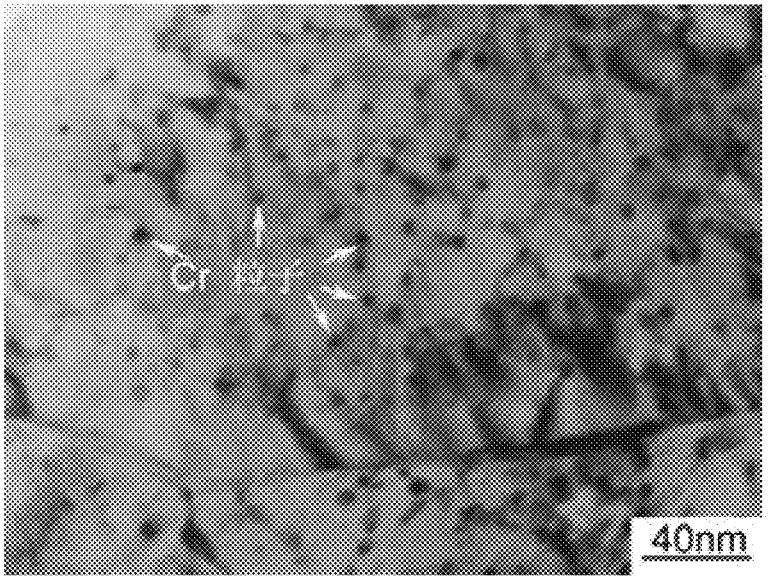
FIG. 4 is a transmission electron microscope (TEM) graph of the Cr nanoparticles in the alloy obtained in Example 3.

The technical solutions of the present invention will be further described with specific embodiments below, but the scope of protection of the present invention is not limited thereto.

Example 1

Using pure Cu, Ag, Cr, Zr and Si as raw materials, the vacuum melting furnace is used to increase the temperature, melt and cast to obtain Cu-12% Ag-0.3% Cr-0.1% Zr-0.05% Si cast rod, and conduct multi-pass drawing on the cast rod at room temperature, to make its cross section shrinking ratio reach 80%. Anneal the obtained sample at 300° C. for 24 h, and continue to draw at room temperature, during which the cross section shrinking ratio is 50%, finally, put the sample in liquid nitrogen for heat preservation for 24 h, then recover the temperature to room temperature at a rate of 10° C./min, so that the obtained alloy contains a large number of fine Ag nano-fibers and Cr, Zr and Si nanoparticles. The average diameter of the nano-fiber is 50 nm, its length is 2000 nm and the distance between fibers is less than 1000 nm. The interface between fiber and Cu matrix is a semi-coherent interface, on which a misfit dislocation appears every 9 Cu (111) atomic plane. The average diameter of Cr, Zr and Si nanoparticles is 30 nm, the distance is less than 200 nm, the phase interface between Cr, Zr and Si nanoparticles and Cu matrix is semi-coherent interface and that between these nanoparticles and X fiber is incoherent interface.

Example 2

Using Cu-20% Nb master alloy, Cu-5% Cr master alloy, pure Zr and pure Si as raw materials, the vacuum melting furnace is used to increase the temperature, melt and cast to obtain Cu-12% Nb-1% Cr-0.2% Zr-0.1% Si cast rod, and conduct multi-pass drawing on the cast rod at room temperature, to make its cross section shrinking ratio reach 85%. Anneal the obtained samples at 300° C. for 16 h, and continue to draw the obtained samples, during which the cross section shrinking ratio is 30%, finally, put the samples in liquid nitrogen for heat preservation for 100 h, then recover the temperature to room temperature at a rate of 5° C./min, so that the obtained alloy contains a large number of fine Nb nanofibers and Cr, Zr, Si nanoparticles. The average diameter of the nano-fiber is 100 nm, its length is greater than 1000 nm, and the distance between fibers is less than 800 nm. The interface between fiber and Cu matrix is a semi-coherent interface, on which a misfit dislocation appears every 13 Cu (111) atomic planes. The average diameter of Cr, Zr and Si nanoparticles is 25 nm, the distance is less than 150 nm, the phase interface between Cr, Zr and Si nanoparticles and Cu matrix is semi-coherent interface and that between these nanoparticles and X fiber is incoherent interface.

Example 3

Using pure Cu, pure Ag, Cu-15% Ta master alloy, Cu-3% Cr master alloy as raw materials, the vacuum melting furnace is used to increase the temperature, melt and cast to obtain Cu-6% Ag-6% Ta-0.1% Cr cast rod, and conduct multi-pass drawing on the cast rod at room temperature, to make its cross section shrinking ratio reach 85%. Anneal the obtained samples at 400° C. for 8 h, and continue to draw the obtained samples, during which the cross section shrinking ratio is 40%, finally, put the samples in liquid nitrogen for heat preservation for 1 h, then recover the temperature to room temperature at a rate of 2° C./min, so that the obtained alloy contains a large number of fine Ag and Ta nanofibers and Cr nanoparticles. The average diameter of the nano-fiber is 100 nm, its length is greater than 1000 nm, and the distance between fibers is less than 1000 nm. The interface between fiber and Cu matrix is a semi-coherent interface, and a misfit dislocation appears every 13 Cu (111) atomic planes on the Cu/Ag interface and a misfit dislocation appears every 10 Cu (111) atomic planes on the Cu/Ta interface. The average diameter of Cr nanoparticles is 20 nm, the distance is less than 100 nm. Cr nanoparticles are dispersed inside the copper grains and on the fiber interface. The phase interface between Cr nanoparticles and Cu matrix is semi-coherent interface and that between Cr nanoparticles and X fiber is incoherent interface.

Example 4

Using pure Cu, pure Ag, a Cu-50% Nb master alloy, Cu-10% Cr master alloy, Cu-15% Zr master alloy and a Cu-5% Si master alloy as raw materials, the vacuum melting furnace is used to increase the temperature, melt and cast to obtain Cu-12% Ag-12% Nb-1.3% Cr-0.4% Zr-0.3% Si cast rod, and conduct multi-pass drawing on the cast rod at room temperature, to make its cross section shrinking ratio reach 95%. Anneal the obtained samples at 300° C. for 8 h, and continue to draw the obtained samples, during which the cross section shrinking ratio is 30%, finally, put the samples in liquid nitrogen for heat preservation for 200 h, then recover the temperature to room temperature at a rate of 10° C./min, so that the obtained alloy contains a large number of fine Ag and Nb nanofibers and Cr, Zr, Si nanoparticles. The average diameter of the nano-fiber is 100 nm, its length is greater than 3000 nm, and the distance between fibers is less than 800 nm. The interface between fiber and Cu matrix is a semi-coherent interface, and a misfit dislocation appears every 9 Cu (111) atomic planes on the Cu/Ag interface and a misfit dislocation appears every 13 Cu (111) atomic planes on the Cu/Nb interface. The average diameter of Cr, Zr and Si nanoparticles is 25 nm, the distance is less than 130 nm. Cr, Zr, Si nanoparticles are dispersed inside the copper grains and on the fiber interface. The phase interface between Cr, Zr and Si nanoparticles and Cu matrix is semi-coherent interface and that between these nanoparticles and X fiber is incoherent interface.

Example 5

Using pure Cu, pure Ag, Cu-20% Cr master alloy, Cu-10% Zr master alloy and Cu-10% Si master alloy as raw materials, the vacuum melting furnace is used to increase the temperature, melt and cast to obtain Cu-3% Ag-0.8% Cr-0.5% Zr-0.3% Si cast rod, and conduct multi-pass drawing on the cast rod at room temperature, to make its cross section shrinking ratio reach 95%. Anneal the obtained samples at 250° C. for 128 h, and continue to draw the obtained samples, during which the cross section shrinking ratio is 50%, finally, put the samples in liquid nitrogen for heat preservation for 100 h, then recover the temperature to room temperature at a rate of 8° C./min, so that the obtained alloy contains a large number of fine Ag nanofibers and Cr, Zr, Si nanoparticles. The average diameter of the nano-fiber is 40 nm, its length is greater than 1500 nm, and the distance between fibers is less than 2000 nm. The interface between fiber and Cu matrix is a semi-coherent interface, and a misfit dislocation appears every 9 Cu (111) atomic planes on the Cu/Ag interface. The average diameter of Cr, Zr and Si nanoparticles is 15 nm, the distance is less than 90 nm. Cr, Zr, Si nanoparticles are dispersed inside the copper grains and on the fiber interface. The phase interface between Cr, Zr and Si nanoparticles and Cu matrix is semi-coherent interface and that between these nanoparticles and X fiber is incoherent interface.

The contents of X and Y solid solution atoms in the copper matrix are determined by energy spectrum for the alloy obtained in above examples. Results are shown in table 1. For the alloys obtained from the above examples, the proportions of nanoparticles on the phase interface between fibers and matrix among the overall nanoparticles are measured using a scanning electron microscopy and transmission electron microscopy combined with energy spectrum techniques. Results are shown in Table 1.

TABLE 1

The contents of copper matrix X and Y solid solution atoms in the alloy in examples and the proportion of nanoparticles in the phase interface between fibers and matrix

| Alloy | Content of X solid solution atoms (%) | Content of Y solid solution atoms (%) | Proportion of nanoparticles in the phase interface between fibers and matrix (%) |
|---|---|---|---|
| Cu—12%Ag—0.3%Cr—0.1%Zr—0.05%Si | 0.3 | 0.03 | 30 |
| Cu—12%Nb—1%Cr—0.2%Zr—0.1%Si | 0.3 | 0.09 | 35 |
| Cu—6%Ag—6%Ta—0.1%Cr | 0.25 | 0.02 | 31 |
| Cu—12%Ag—12%Nb—1.3%Cr—0.4%Zr—0.3%Si | 0.45 | 0.08 | 43 |
| Cu—3%Ag—0.8%Cr—0.5%Zr—0.3%Si | 0.1 | 0.04 | 51 |

For alloy obtained in the above examples, the strength is determined by standard tensile test and the room temperature conductivity is determined by four-point method, and the strength reduction rate is determined under 400° C. for annealing for 2 h. The results are shown in Table 2.

TABLE 2

Main performance of alloy

| Alloy | Strength (MPa) | Conductivity (% IACS) | Strength reduction rate under 400° C. for annealing for 2 hours |
|---|---|---|---|
| Cu—12%Ag—0.3%Cr—0.1%Zr—0.05%Si | 680 | 81 | 9% |
| Cu—12%Nb—1%Cr—0.2%Zr—0.1%Si | 720 | 78 | 5% |
| Cu—6%Ag—6%Ta—0.1%Cr | 700 | 79 | 7% |
| Cu—12%Ag—12%Nb—1.3%Cr—0.4%Zr—0.3%Si | 750 | 78 | 3% |
| Cu—3%Ag—0.8%Cr—0.5%Zr—0.3%Si | 685 | 83 | 9% |
| Reference alloy CuCrZrZnCoTiLa* | 608.2 | 70 | None |

*Data of reference alloy CuCrZrZnCoTiLa are from patent CN1417357A.

What is claimed is:

1. A copper alloy, having the following features:

(1) The copper alloy composition conforms to the form: CuXY, of which X is selected from at least one of Ag, Nb and Ta, Y is from at least one of Cr, Zr and Si; in the copper alloy, the total content of X element shall be greater than 0.01 mass percent (m %) and no higher than 20 m %, the total content of Y element shall be greater than 0.01 m % and no higher than 2 m %, the Cr content ranges from 0.01 m % to 1.5 m %, Zr content ranges from 0.01 m % to 0.5 m %, and Si content ranges from 0.01 m % to 0.3 m %;

(2) At room temperature, X element in the copper alloy exists in the forms of pure phase and solid solution atom, of which the X content in the latter form is less than 0.5 m %; Y element exists in the forms of pure phase and solid solution atom or CuY compound and solid solution atom, of which the Y content in the form of solid solution atom is less than 0.1 m %;

(3) The copper alloy exists in the form of long bar or wire, of which X element in the form of pure phase is embedded in the copper alloy in the form of approximately parallel arranged fibers, the axial direction of the fiber is roughly parallel to that of the copper alloy bar or wire, and the diameter of the fiber is less than 100 nm, its length is greater than 1000 nm and the distance between fibers is less than 1000 nm, the phase interface between fiber and Cu matrix is a semi-coherent interface, on which periodically arranged misfit dislocation is distributed;

Y element in the form of pure phase or compound is embedded in the copper alloy in the form of particles, and over 30% particles are distributed on the phase interface between X fiber and Cu matrix, the diameter of particles is less than 30 nm, the distance between particles is less than 200 nm, and the phase interface between particle and Cu matrix and between particle and X fiber is semi-coherent interface or incoherent interface.

2. The copper alloy according to claim 1, wherein the total content of X element in the copper alloy is 3 m %~12 m %.

3. The copper alloy according to claim 1, wherein the total content of Y element in the copper alloy is 0.1 m %~1.5 m %.

4. The copper alloy according to claim 1, wherein the copper alloy is one of the following:

Cu-12 m % Ag-0.3 m % Cr-0.1 m % Zr-0.05 m % Si,

Cu-12 m % Ag-12 m % Nb-1.3 m % Cr-0.4 m % Zr-0.3 m % Si,

Cu-0.1 m % Ag-0.1 m % Cr-0.1 m % Zr,

Cu-12 m % Nb-1 m % Cr-0.4 m % Zr-0.1 m % Si,

Cu-6 m % Ag-6 m % Ta-0.1 m % Cr,

Cu-3 m % Ag-0.8 m % Cr-0.5 m % Zr-0.3 m % Si.

5. The copper alloy according to claim 1, wherein the strength of the copper alloy reaches over 690 MPa, its conductivity reaches over 79% and the strength reduction rate <10% after annealing at 400° C. for 2 h.

6. The copper alloy according to claim 1, wherein the copper alloy is prepared through the following method:

put the simple substance and/or intermediate of copper alloy raw materials into a vacuum melting furnace according to the copper alloy composition as recited in feature (1), increase the temperature of the vacuum melting furnace, melt and cast in a mould to obtain an ingot casting, transform the ingot casting into a long bar or wire after multi-pass drawing at room temperature, to make the cross section shrinking ratio of the long bar or wire reach over 80%, then anneal the long bar or wire at a temperature without spheroidizing fracture of fibers of the total content of X element and with making the total content of Y element form nano-sized precipitated phase, and the annealing time shad be selected without spheroidizing fracture of fibers of the total content of X element and with making the total content of Y element greater than 50% form nano-sized precipitated phase, and draw the long bar or wire again, during which the cross section shrinking ratio of the long bar or wire is less than 50%, then freeze the drawn long bar or wire with liquid nitrogen, so that the residual X or Y solid solution atom in a copper matrix continue to separate out, then increase the temperature to room temperature to obtain the copper alloy.

7. The copper alloy according to claim 6, wherein the duration for liquid nitrogen freezing treatment is 1~100 hour(s).

8. The copper alloy according to claim 6, wherein the temperature is increased to room temperature at a rate of 2~10° C./min after liquid nitrogen freezing treatment of the alloy.

9. The copper alloy according to claim 7, wherein the temperature is increased to room temperature at a rate of 2~10° C./min after liquid nitrogen freezing treatment of the alloy.

* * * * *